US006511569B1

(12) United States Patent
Nixon et al.

(10) Patent No.: US 6,511,569 B1
(45) Date of Patent: Jan. 28, 2003

(54) METHOD FOR IN-LINE FOLDING AND AFFIXING OF TUCK LABEL

(75) Inventors: Tracy S. Nixon, Bellbrook, OH (US); David F. Laurash, Bellbrook, OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 10/027,091

(22) Filed: Dec. 20, 2001

Related U.S. Application Data

(62) Division of application No. 09/322,631, filed on May 28, 1999, now Pat. No. 6,378,588.

(51) Int. Cl.[7] ..... B31F 7/00; B31D 1/02

(52) U.S. Cl. ..... 156/227; 156/285; 156/297; 156/DIG. 2; 156/249

(58) Field of Search ..... 156/217, 227, 156/290, 297, DIG. 2, DIG. 38, DIG. 39, DIG. 4, DIG. 9, 285, 249

(56) References Cited

U.S. PATENT DOCUMENTS

| | | | | |
|---|---|---|---|---|
| 1,467,021 A | * | 9/1923 | Tzibides | 156/DIG. 39 |
| 4,255,220 A | * | 3/1981 | Kucheck et al. | 156/285 |
| 5,031,939 A | | 7/1991 | Webendorfer et al. | |
| 5,071,167 A | * | 12/1991 | O'Brien | 283/79 |
| 5,137,506 A | | 8/1992 | Haenel et al. | |
| 5,413,383 A | | 5/1995 | Laurash et al. | |
| 5,626,710 A | | 5/1997 | Moll | |
| 5,636,017 A | | 6/1997 | Morrow | |
| 5,674,334 A | | 10/1997 | Instance | |
| 6,006,808 A | | 12/1999 | Ewert et al. | |

* cited by examiner

*Primary Examiner*—Michael W. Ball
*Assistant Examiner*—Todd J. Kilkenny
(74) *Attorney, Agent, or Firm*—Killworth, Gottman, Hagan & Schaeff LLP

(57) ABSTRACT

An apparatus is provided for in-line folding and affixing a label to an article, the label having a fold line thereacross defining a foldable portion and a cover portion of the label. The apparatus comprises a transfer grid having one or more rollers to convey the label from a first end of the transfer grid to a second end of the transfer grid. An opening is defined between two of the rollers intermediate the first and second ends of the transfer grid. The transfer grid conveys the label in a substantially unfolded orientation from the first end of the transfer grid to the opening of the transfer grid such that the foldable portion of the label is projective through the opening. A folding station is adjacent the opening and receives the foldable portion of the label, urging a projecting portion of the foldable portion over the cover portion to define a substantially folded-over orientation of the label. The transfer grid conveys the label being in the substantially folded-over orientation from the opening of the transfer grid to the second end of the transfer grid, whereat an affixing station is provided adjacent the second end of the transfer grid to receive the label and affix the label to the article.

16 Claims, 7 Drawing Sheets

METHOD FOR IN-LINE FOLDING AND AFFIXING OF TUCK LABEL

CROSS REFERENCE TO RELATED APPLICATIONS

This application is a divisional of U.S. patent application Ser. No. 09/322,631 filed May 28, 1999 now U.S. Pat. No. 6,378,588.

BACKGROUND OF THE INVENTION

1. Technical Field of the Invention

The present invention relates to apparatuses and methods for affixing a self-adhesive label to an article. More particularly, the present invention relates to an apparatus and a method for affixing a self-adhesive label to an article, wherein the apparatus folds the label prior to affixing the label to the article.

2. Description of the Related Art

Containers used to ship articles, such as corrugated cardboard boxes, often have a label adhesively affixed thereto for the purpose of displaying therefrom information relating to, for example, the shipping instructions, the customer's identity or the container's contents. Particularly, businesses shipping goods based on customer orders require a substantial amount of information to be generated so that persons taking the order, filling the order, shipping the order, billing the order, etc., can perform their respective jobs to insure that the goods reach their intended destination. Typically, this information is printed on one or more labels which are affixed to the container, and which may contain printable items, such as, invoices, customer receipts, common carrier tracking labels, warehouse picking lists and returned goods forms.

For example, U.S. Pat. No. 5,413,383 to Laurash, et al., teaches a printable, foldable, self-adhesive "tuck label" having one or more flaps defining detachable portions thereof which may be removed from the tuck label even after the label has been adhesively affixed to a container. The detachable portions may have information and items such as those described above either pre-printed thereon or contained therein to facilitate shipping and handling of the container and its contents. A tuck label, such as the those described in the Laurash '383 patent, are typically affixed to a container by a worker's removing the unfolded tuck label from a release sheet, folding the tuck label into the proper orientation and manually affixing the folded tuck label to the container. Thus, it is desirable to provide an apparatus and method for automatedly affixing a label, such as, a tuck label, to an article, such as, a shipping container or the like.

For example, U.S. Pat. No. 5,674,334 to Instance teaches an apparatus for manufacturing a folded label wherein a continuous strip of label material is cut into predetermined lengths, folded, adhered to a pressure-sensitive adhesive backing and applied to a release sheet in a folded-over orientation. The folded-over label is then removed from the release sheet and affixed to an article, such as, as shipping container. However, it is furthermore desirable to provide an apparatus for removing an unfolded label from a release sheet, automatedly folding the label into a predetermined orientation and affixing the folded label to an article, such as a shipping container or the like. It is even furthermore desirable to provide a method for folding and affixing a self-adhesive label to a container, wherein the steps of folding and affixing the self-adhesive label to the container are performed in an in-line process.

Accordingly, there remains a need in the art for an apparatus and method for in-line folding and affixing a self-adhesive label to an article, such as, for example, a shipping container or the like.

SUMMARY OF THE INVENTION

The present invention is for an apparatus and method for in-line folding and affixing a self-adhesive label to an article, such as, for example, a shipping container or the like. The apparatus for in-line folding and affixing a self-adhesive label to an article, such as a shipping container, according to a preferred embodiment of the present invention includes a printing station, a label transfer grid, a folding station and an affixing station.

The labels, which may be affixed to a release liner, are individually fed into the printing station, which prints indicia thereon, such as invoice, receipt, shipping or inventory information. Labels exiting the printing station are fed into a first end of the transfer grid, which generally comprises two curved rows of rollers in spaced relation to one another to transfer the labels therethrough. An opening is defined, preferably between two rollers of the second row, through which a leading edge of the label is guided to project outwardly from the grid towards the folding station. As the label is conveyed forwardly through the grid, a foldable portion of the label is temporarily diverted into the folding station and thereby guided into a substantially folded-over orientation. Once the foldable portion of the label substantially projects through the opening, an air blast emitted from an air blast nozzle urges a folded edge of the label back through the opening and again into the grid, which conveys the folded-over label towards a second end thereof. The grid deposits the folded-over label onto a transfer plate of the affixing station, which includes one or more vacuum nozzles to hold the folded-over label temporarily thereagainst. Once the label is positioned over a portion of the transfer plate, a reciprocating arm, affixed to the transfer plate, presses the label against an article positioned nearby. One or more adhesive strips provided on the exposed surface of the folded-over label, then, adhesively affix the label to the article.

One aspect of the present invention is to provide an apparatus for in-line folding and affixing a label to an article, the label having a fold line thereacross, the fold line defining a foldable portion of the label and a cover portion of the label, the apparatus comprising a transfer grid having one or more rollers to convey the label from a first end of the transfer grid to a second end of the transfer grid, the one or more rollers defining an opening intermediate the first and second ends of the transfer grid, the transfer grid conveying the label being in a substantially unfolded orientation from the first end of the transfer grid to the opening of the transfer grid, the foldable portion of the label being projective through the opening; a folding station adjacent the opening, the folding station urging a portion of the foldable portion projecting through the opening over the cover portion to define a substantially folded-over orientation of the label, the transfer grid conveying the label being in the substantially folded-over orientation from the opening to the second end of the transfer grid; and, an affixing station adjacent the second end of the transfer grid, the affixing station receiving the label being in the substantially folded-over orientation and affixing the label to the article.

Another aspect of the present invention is to provide a method of in-line folding and affixing a label to an article, the label having a fold line thereacross, the fold line defining a foldable portion of the label and a cover portion of the label, the method comprising the steps of providing a transfer grid for conveying the label from a first end of the transfer grid to a second end of the transfer grid, the transfer grid having an opening intermediate the first and second ends; providing a folding station adjacent the opening; providing an affixing station adjacent the second end of the transfer grid; inserting the label into the first end of the transfer grid; the transfer grid conveying the label in a substantially unfolded orientation from the first end of the transfer grid to the opening, the foldable portion of the label being projective through the opening; the folding station folding the foldable portion of the label over the cover portion of the label to define a substantially folded-over orientation of the label; the transfer grid conveying the label being in the substantially folded-over orientation from the opening to the second end of the transfer grid; the affixing station receiving the label being in the substantially folded-over orientation from the second end of the transfer grid; and, the affixing station affixing the label to the article.

It is an object of the present invention to provide an apparatus and method for automatedly affixing a label, such as, a tuck label, to an article, such as, a shipping container or the like.

It is another object of the present invention to provide an apparatus for removing an unfolded label from a release sheet, folding the label into a predetermined orientation and affixing the folded label to an article, such as a shipping container or the like.

It is still another object of the present invention to provide a method for folding and affixing a self-adhesive label to a container, wherein the steps of folding and affixing the self-adhesive label to the container are performed in an in-line process.

These and additional objects, features and advantages of the present invention will become apparent to those reasonably skilled in the art from the description which follows, and may be realized by means of the instrumentalities and combinations particularly pointed out in the claims appended hereto.

BRIEF DESCRIPTION OF THE DRAWINGS

A better understanding of the present invention will be had upon reference to the following description in conjunction with the accompanying drawings in which like reference numerals represent like parts, and wherein.

DETAILED DESCRIPTION OF THE PREFERRED EMBODIMENTS

Figure 2:
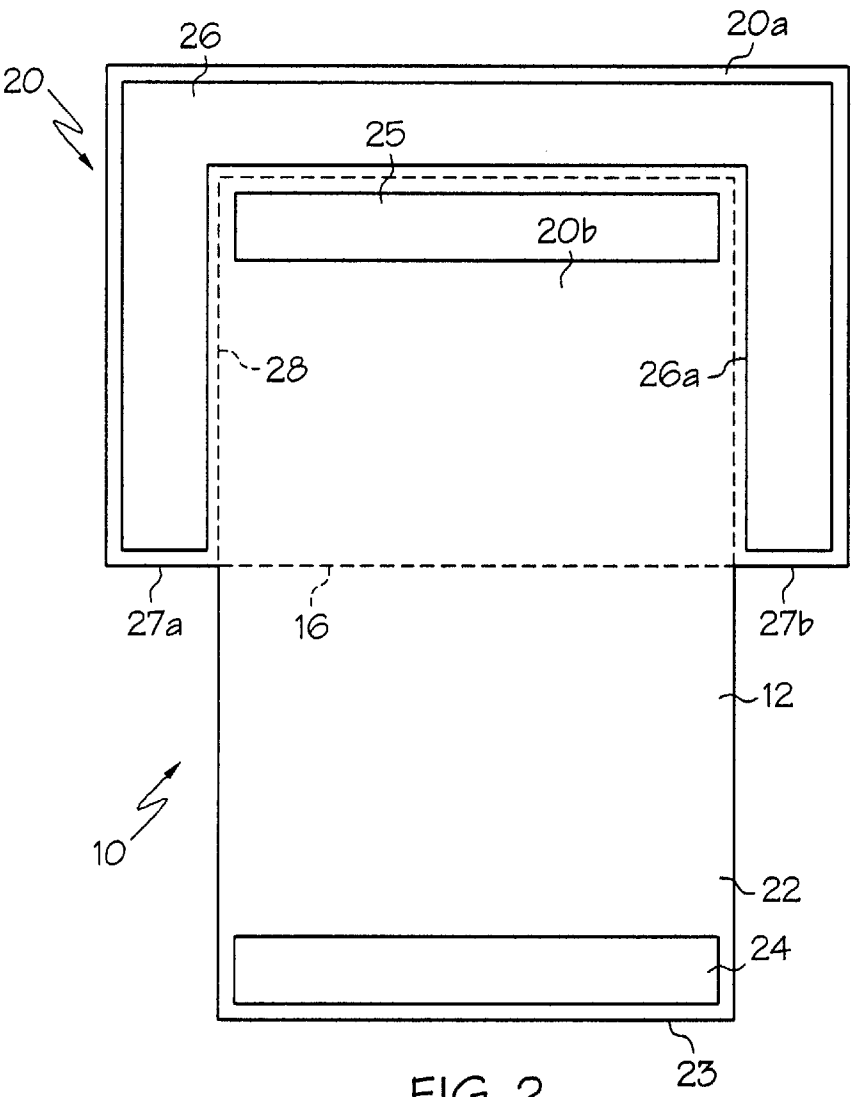
FIG. 2 is a front view of the tuck label of FIG. 1, shown in an unfolded orientation.

With combined reference to FIGS. 1–5, a conventional tuck label 10 is affixable, such as, for example, by adhesive, to one surface 31 of a container 30, for example, a corrugated cardboard box used to ship articles therein. Any foldable label known to those of ordinary skill in the art may be used for the purposes herein described and the within description is not intended to limit the scope of the present invention to only those foldable tuck labels of the type shown and described herein. For example, although the preferred embodiment hereof will be described with reference to a tuck label having one fold line thereacross defining two flaps thereby, the apparatus and method of the present invention are adaptable by those of ordinary skill in the art to fold and affix tuck labels having a plurality of fold lines thereacross, in any orientation thereon, defining any number of flaps thereby.

The preferred tuck label 10 is constructed from a planar sheet of foldable, printable material, such as, for example, plain paper, having a first planar surface 12 and a second planar surface 14. The first planar surface 12 of the tuck label 10 is adapted to be coated with an adhesive film, for example, pressure-sensitive or re-wettable adhesive, for the purpose of adhesively affixing the tuck label 10 to the surface 31 of the container 30 as described in greater detail below. The second planar surface 14 of the tuck label 10 is adapted to have indicia printed thereon, such as, for example, shipping, billing or customer information, or any additional information relating to the contents of the container 30.

The tuck label 10 is divided by a fold line 16, which defines a cover portion 20 of the tuck label 10 and a foldable portion 22 of the tuck label 10, wherein the foldable portion 22 is upwardly foldable about the fold line 16 such that the first planar surface 12 of the foldable portion 22 is adhesively affixable to the first planar surface 12 of the cover portion 20. A strip of adhesive 24 coats a distal end 23 of the foldable portion 22 and is positioned thereon such that, when the foldable portion 22 is folded upwardly over the first planar surface 12 of the cover portion 20, adhesive strip 24 is removably adhesively affixed to a release strip 25, such as, for example, of silicone, which coats a portion of the first planar surface 12 of the cover portion 20. Although adhesive strip 24 and release strip 25 have been described herein as being separate layers superimposed over portions of the tuck label 10, it will be understood that these layers need not be self-supporting layers at all, but rather are shown herein as such for clarity.

An inverted "U"-shaped adhesive border 26 coats the first planar surface 12 of the tuck label 10 along three edges of the cover portion 20 and is sized, shaped, and positioned such that, when the foldable portion 22 is folded over the cover portion 20, the foldable portion 22 resides within the border 26, but is not adhesively affixed thereto. As such, cover portion 20 defines shoulders 27*a*, 27*b* between which foldable portion 22 is positioned.

The cover portion 20 includes a perforation line 28 which is offset inwardly along an inner edge 26*a* of the adhesive border 26 defining a removable portion 20*b* of the cover portion 20 which is sized substantially as the foldable portion 22 of the tuck label 10. The perforation line 28 permits a removable portion 20*b* of the cover portion 20 to be separated from a frame portion 20*a* of the cover portion 20 and to be removed therefrom even after the tuck label 10 has been affixed to the container 30, as described in greater detail below. Adhesive strip 24 and release strip 25 are preferably sized, shaped and positioned to reside within the perforation line 28 such that the foldable portion 22 of the label 10 may be removed from the frame portion 20*a*, along with the removable portion 20*b* of the cover portion 20.

The tuck label 10 is typically affixed to the surface 31 of the container 30 by folding the foldable portion 22 over the cover portion 20 and by releasably adhesively affixing the first planar surface 12 of the foldable portion 22 to the first planar surface 12 of the cover portion 20, such as, for example, as between adhesive strip 24 and release strip 25. The tuck label 10, then, is adhesively affixed to the surface 31 of the container 30, such as, by adhesive border 26, whereby the foldable portion 22 is sandwiched between the cover portion 20 and the container 30, but wherein the foldable portion 22, itself, is not adhesively affixed to the container 30 because the foldable portion 22 resides within adhesive border 26. With specific reference to FIG. 5, tearing the cover portion 20 of the tuck label 10 along perforation line 28 detaches the removable portion 20*b* of the cover portion 20 (and the foldable portion 22) from the frame portion 20*a* of the cover portion 20, thereby permitting removal of the removable portion 20*b*, which may contain invoice, shipping or other information printed thereon.

Figure 7:
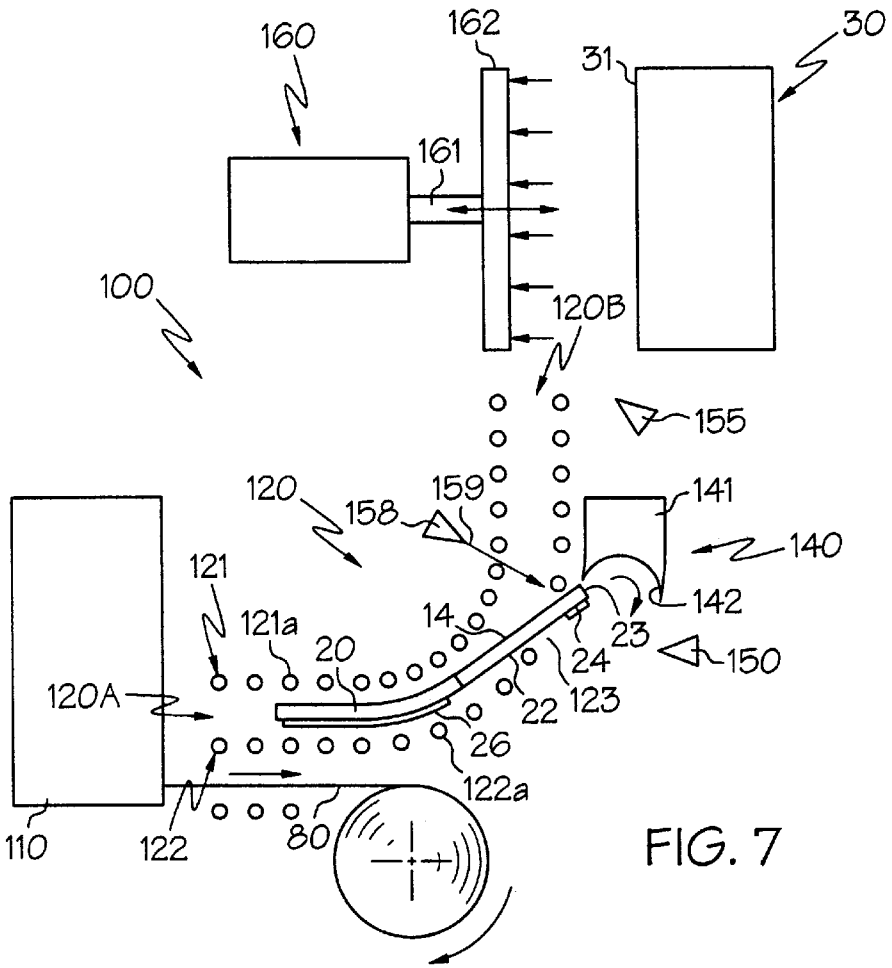
FIG. 7 is a diagrammatic elevation view of an in-line tuck label folding and affixing apparatus according to a preferred embodiment of the present invention, showing a tuck label entering a folding station thereof.
Figure 6:
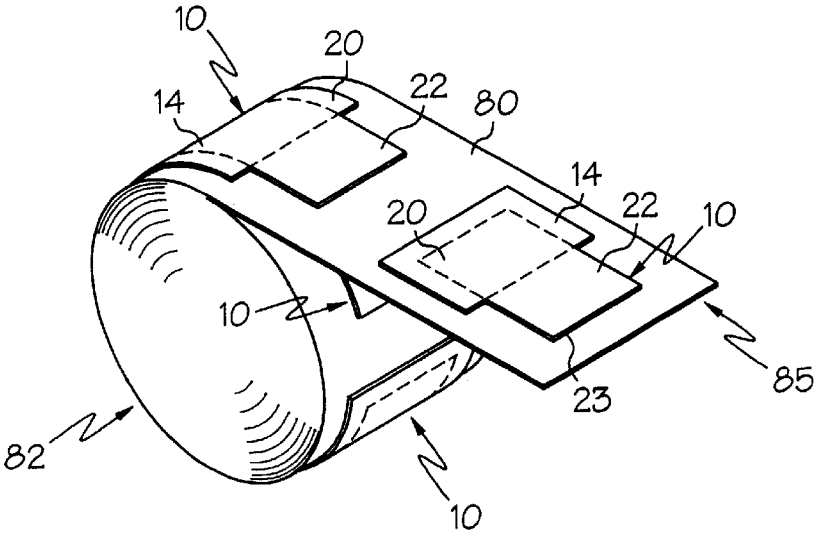
FIG. 6 is an oblique perspective view of a plurality of tuck labels of FIG. 1, shown removably affixed to a release sheet and wound into a roll.

With reference now to FIGS. 6 and 7, a preferred apparatus and method for in-line folding and affixing the tuck label 10 to the surface 31 of the container 30 is illustrated. Preferably, a plurality of tuck labels 10 are provided in an unfolded (such as is shown in FIG. 2), end-to-end orientation with the foldable portion 22 of each tuck label 10 leading the cover portion 20 thereof. Alternatively, the labels 10 may be in a side-by-side orientation (not shown), wherein a sideways edge of each label 10 defines the leading edge thereof (FIG. 13), or in a backwards end-to-end orientation (not shown), wherein the cover portion 20 leads the foldable portion 22 thereof.

The labels 10 are removably adhesively affixed to a continuous release sheet 80, such as, for example, a paper liner coated with silicone, thereby defining a label web 85, to permit each label 10 to be removed from the release sheet 80 for individual attachment thereof to a container 30. The labels 10 are preferably affixed to the release sheet 80 such that the first planar surface 12 of the cover portion 20 of the labels 10, on which adhesive strip 24 and adhesive border 26 are provided, contacts the release sheet 80, whereby adhesive strip 24 and adhesive border 26 adhesively affix the label 10 to the release sheet 80. The silicone coating on the release sheet, however, permits each label 10 to be removed from the release sheet 80 with the adhesive strip 24 and the adhesive border 26 remaining on the first planar surface 12 of the label 10 for later affixing the label 10 to the container 30. The release sheet 80, with the labels 10 adhesively affixed thereto, is preferably wound into a roll 82 to facilitate transportation and handling thereof, wherein labels may be continuously fed into the apparatus 100. Alternatively, labels 10 may be provided on individual release sheets which are stacked or fan-folded for individual feeding into the apparatus 100.

The apparatus 100 for in-line folding and affixing the tuck label 10 to the surface 31 of the container 30 includes a printing station 110, a label transfer grid 120, a folding station 140, first, second and third air blast nozzles 150, 155, 158, respectively, and an affixing station 160. The printing station 110 includes any conventional impact or non-impact printing device adapted to print information on individual tuck labels 10. The label web 85 may be fed into the printing station 110 with the labels 10 affixed to the release sheet 80 during printing, in which case, the printing station 110 prints predetermined information on the exposed second planar surface 14 of the tuck label 10. The information printed on the labels 10 may be the same for each label 10, for example, to indicate the shipper's address, or may vary as between the labels 10, such as, to indicate the destination address. Alternatively, the labels 10 may not be affixed to a release sheet at all, such as, for example, with respect to linerless labels or labels having a re-wettable adhesive on one surface thereof, in which case, the printing station 110 may print information on the first planar surface 12 of the label 10, such as between adhesive strip 24 and release strip 25, in addition to printing information on the second planar surface 14 of the label 10. In either case, however, labels 10 exit the printing station 110 one at a time, and, where a release sheet 80 has been provided, the individual labels 10 have been removed from the release sheet 80, which may then be re-wound into a roll either before or after the printing station 110. That is, if the labels 10 pass through the printing station 110 affixed to the release sheet 80 and are removed from the release sheet 80 after the printing station 110 (such as is shown in FIGS. 7–10), then the release sheet 80 is wound into a roll after the printing station 110. The printing station 110 prints information on the second planar surface 14 of the labels 10 which are then removed from the release sheet 80 as the label web 85 exits the printing station 110. The individual labels 10 enter the label transfer grid 120, one at a time, as the continuous release sheet 80 is rewound for re-use or discarding thereof.

The label transfer grid 120 includes an inner row 121 of rollers 121*a* and an outer row 122 of rollers 122*a*, wherein the rollers 122*a* of the outer row 122 are spaced from the rollers 121*a* of the inner row 121 by a sufficient distance to grip the tuck label 10 therebetween and to convey the tuck label 10 from the printing station 110 to the transfer station 160 along a generally upwardly-curved path. At least one of the rollers 122*a* in the outer row 122 is motorized, although not all rollers 122*a* need to be motorized. Moreover, one or more rollers 121*a* of the inner row 121 may be motorized, although none of the rollers 121*a* need to be motorized. Although the spacing between rows 121, 122 is shown in the Figures as being much larger than the thickness of the label 10 being conveyed thereby, this exaggerated distance is shown for clarity only and those of ordinary skill in the art will understand that the spacing between rows 121, 122 will, in fact, be much smaller than that shown, and preferably be only slightly larger than the thickness of the labels 10 being conveyed thereby. The spacing between rows 121, 122 may also be adjustable using any known technique which permits labels having varying thicknesses to be conveyed thereby. It will also be obvious to those of ordinary skill in the art that, because the tuck label 10 being conveyed by the label transfer grid 120 has been removed from the release sheet 80, the adhesive strip 24 and the adhesive border 26 of the label 10 are exposed to the rollers 121. Accordingly, rollers 121*a*, 122*a*, and particularly, outer rollers 122*a*, may be coated with silicone or another similar material to prevent the label 10 from sticking to the rollers 121*a*, 122*a*.

As can be clearly seen in FIG. 7, transfer grid 120 includes a first end 126A, located adjacent printing station 110, and a second end 120B, located adjacent affixing station 160. Generally, label transfer grid 120 conveys the label 10 from the printing station 110, from which the label 10 typically exits in a substantially horizontal orientation, to the affixing station 160, wherein the label 10 is in a substantially vertical orientation to be affixed to the substantially vertical sidewall surface 31 of the container 30. The label transfer grid 120, then, includes a generally upwardly-curved bend, by which the flexible label 10 moves from a substantially horizontal orientation to a substantially vertical orientation for affixing to the container 30. However, the orientation of the label 10 need not be altered by a bend in the grid 120, and the label 10 may be of any orientation suitable to be affixed to the container 30 as it exits the grid 120. For example, if surface 31 of container 30 is substantially horizontal, label 10 should exit the grid 120 in an orientation suitable to be affixed to the horizontal surface of the container 30.

The outer row 122 of rollers 122*a* includes an opening 123 which is defined as an absence of one or more rollers in the outer row 122. Alternatively, the opening 123 may be defined by the spacing between two consecutively-spaced rollers 122*a* in the outer row 122, wherein the spacing between two consecutively-spaced rollers 122*a* is sufficient to permit the label 10 to pass therebetween. Remaining rollers 122*a* are spaced to pass the label 10 therealong and to convey the label 10 through the grid 120.

The opening 123 is sized to allow the leading edge 23, that being in the preferred embodiment, the foldable portion 22 of the tuck label 10, to pass outwardly from within the grid 120, through the opening 123 and towards the folding station 140 as the label 10 is conveyed through the generally upwardly-curved bend of the transfer grid 120. The third air blast nozzle 158 is positioned alongside the inner row 121 of rollers 121*a* and is directed towards the outer row 122 of rollers 122*a* to emit a stream of pressurized air through the grid 120, as shown generally by reference numeral 159. Air stream 159 urges the leading edge 23 of the foldable portion 22 of the label 10 through the opening 123, to project from within the grid 120 and outwardly towards the folding station 140. A conventional timing control circuit, such as a programmable logic controller, is provided with sensors and valves to signal the air blast 159 to urge the leading edge 23 of the foldable portion 22 of the label through the opening 123. Alternatively, rollers 121*a*, 122*a* may be driven by one or more stepper motors, in which case, air blast 159 may be controlled with reference to movement of the stepper motor (and, as such, by the location of the label 10 in the grid 120), instead of by the programmable timing controller. Alternatively still, the air blast 159 may be a continuous stream of pressurized air being emitted from the air blast nozzle 158.

As the grid 120 conveys the label 10 towards the second end thereof, forward movement of the label 10 along the rollers 121*a*, 122*a* is diverted temporarily through the opening 123 towards the folding station 140. Forward movement of the label 10 by the grid 120, then, advances the foldable portion 22 of the label 10 further out of the grid 120.

Figure 9:
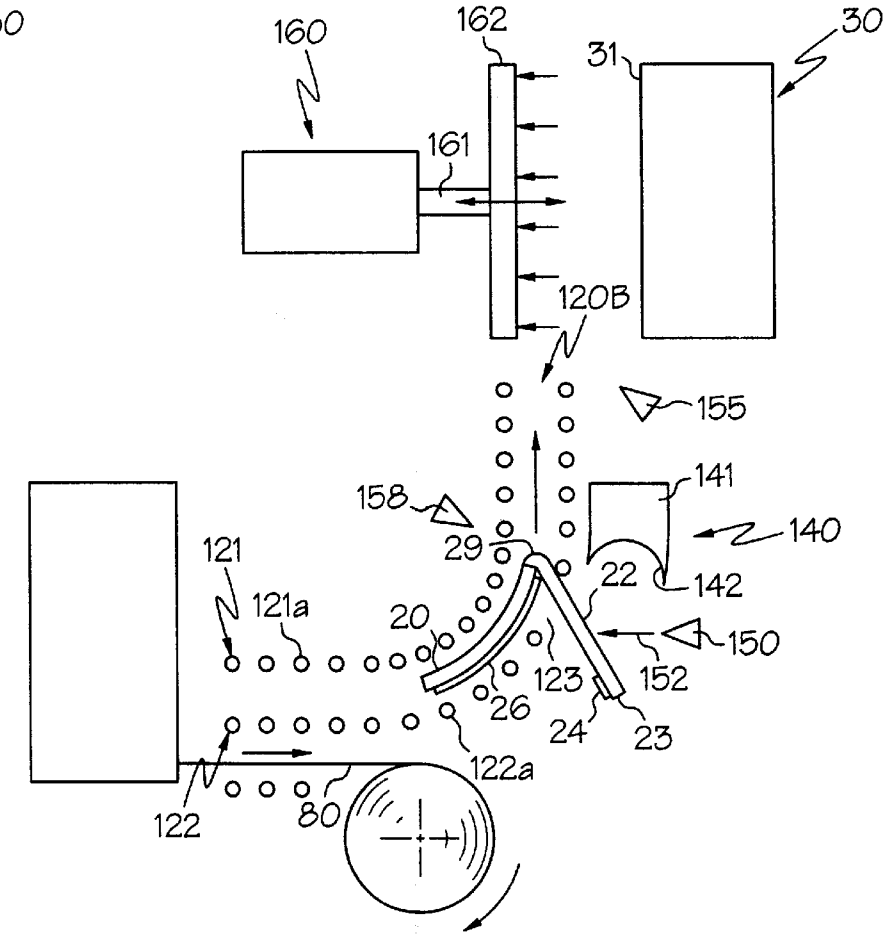
FIG. 9 is a diagrammatic elevation view of the apparatus of FIG. 7, showing the tuck label in a folded orientation leaving the folding station thereof.
Figure 8:
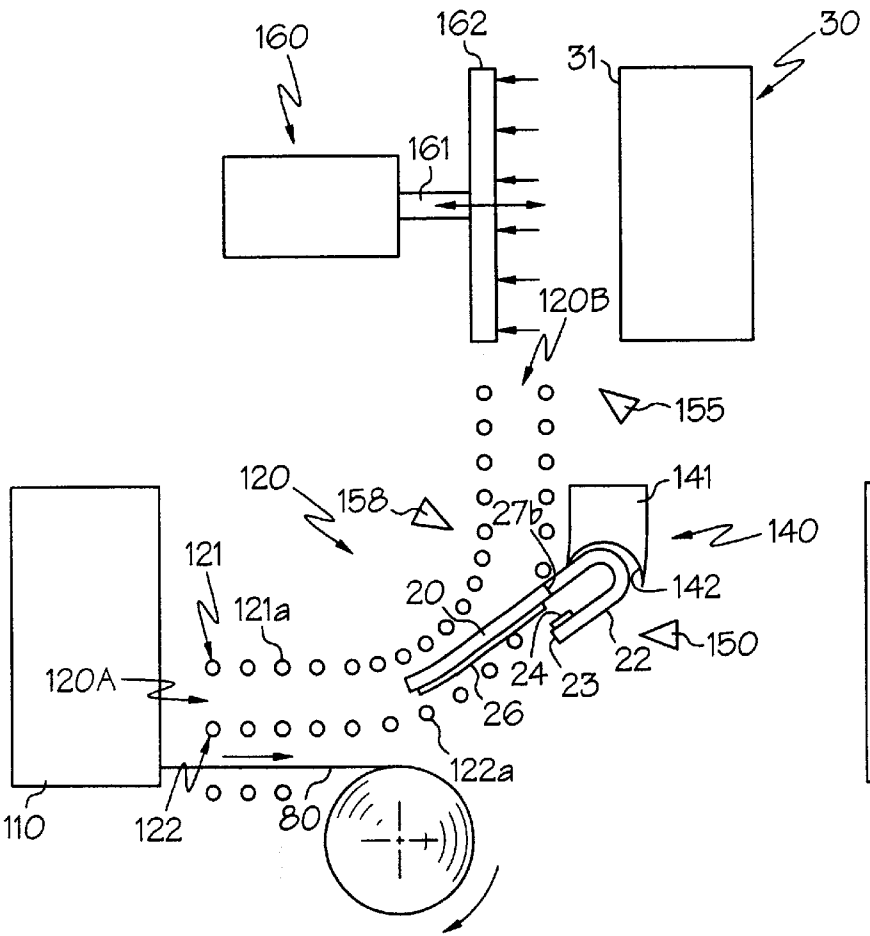
FIG. 8 is a diagrammatic elevation view of the apparatus of FIG. 7, showing a portion of the tuck label being folded in the folding station thereof.

With reference to FIGS. 8 and 9, the folding station 140 includes a reversing block 141 having a curved surface 142, or any surface having a shape adapted to receive the foldable portion 22 of the tuck label 10 therein and to guide the foldable portion 22 of the tuck label 10 towards the grid 120 in a direction substantially opposite to the forward motion of the foldable portion 22 of the tuck label 10 as it exits the transfer grid 120 through the opening 123. The foldable portion 22 of the tuck label 10 exits the grid 120 through the opening 123 due to the forward movement of the label 10 by the grid 120, the foldable portion 22 of the tuck label 10 is thereby further folded backwardly, over the cover portion 20 of the tuck label 10, still being held within the grid 120, but moving towards the opening 123. When the fold line 16, which adjoins shoulders 27*a*, 27*b*, nears the opening 123, air blast nozzle 150 emits a temporary blast of pressurized air in the direction shown generally by reference numeral 152 towards the partially-folded foldable portion 22 of the tuck label 10 projecting from within the grid 120. The air blast 152 folds the foldable portion 22 of the label 10 further over the cover portion 20 thereof and urges the folded edge 29 of the tuck label 10 back into the opening 123 and into the grid 120, where rollers 121*a*, 122*a* grab the folded edge 29 of the tuck label 10 and convey the tuck label 10, now with the folded edge 29 thereof leading, upwardly towards the affixing station 160.

A conventional timing control circuit, such as a programmable logic controller, is provided with sensors and valves to signal the air blast 152 when the label 10 is positioned within the grid 120 to permit folding thereof according as described, and which may also control the timing of the air blast 159 from the third air blast nozzle 158 in relation to the air blast 152 of the first air blast nozzle 150. Alternatively, the air blast 152 may be a continuous stream of pressurized air being emitted from the air blast nozzle 150. As the tuck label 10 passes upwardly alongside the opening 123, the foldable portion 22 thereof is drawn back into the grid 120, through the opening 123. When the foldable portion 22 of the tuck label 10 is again fully within the grid, now folded over the cover portion 20, the strip of adhesive 24 is pressed against the release strip (FIG. 2) by opposing rollers 121*a*, 122*b*.

Figure 11:
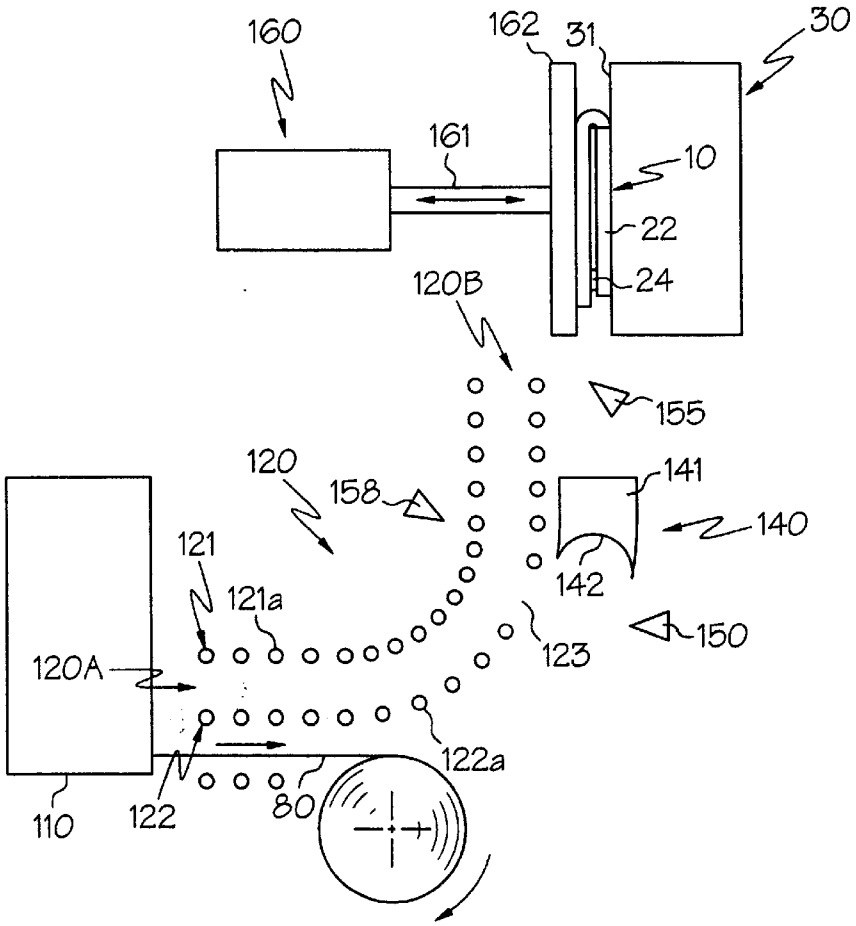
FIG. 11 is a diagrammatic elevation view of the apparatus of FIG. 7, showing the tuck label being affixed to the container of FIG. 1.
Figure 10:
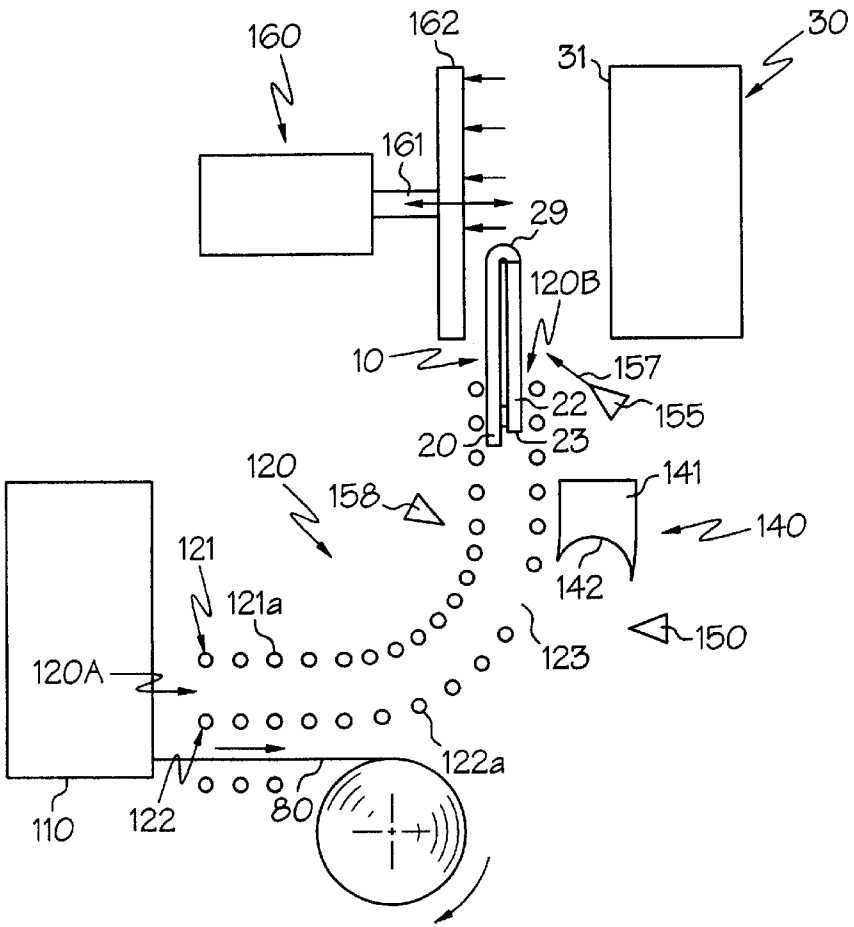
FIG. 10 is a diagrammatic elevation view of the apparatus of FIG. 7, showing the tuck label in a folded orientation entering a transfer station thereof.

With reference to FIGS. 10 and 11, the affixing station 160 includes a reciprocating member 161, such as a translatable rod reciprocally connected to a pneumatic cylinder, and a transfer plate 162 fixedly secured to a distal end of the member 161. The reciprocating member 161 moves between a retracted position, shown generally in FIG. 10, and an extended position, shown generally in FIG. 11. While in the retracted position, the transfer plate 162 is positioned upwardly adjacent the vertical portion of the label transfer grid 120, to receive a label 10 thereover. As the label 10 exits the vertical portion of the grid 120, an air blast, shown generally in FIG. 10 by reference numeral 157, is emitted from air blast nozzle 155 to urge the label 10 against the transfer plate 162. Transfer plate 162 includes a plurality of vacuum nozzles connected to a vacuum source which cooperates to hold the label 10 thereagainst as the reciprocating member 161 moves the transfer plate 162 from the retracted position to the extended position and presses the first planar surface 12 of the cover portion 20, and the second planar surface 14 of the foldable portion 22, against the surface 31 of the container 30. A conventional timing control circuit, such as a programmable logic controller, is provided with sensors and valves to signal the air blast 157 when the label 10 is exiting the transfer grid 120. Alternatively, the air blast 157 may be a continuous stream of pressurized air being emitted from the air blast nozzle 155.

Once the label 10 is positioned over the transfer plate 162, a control circuit energizes the reciprocating member 161 to move the transfer plate 162 towards the container 30, which has moved into the position shown generally in the Figures by an external conveying device (not shown). The container 30 is restrained to permit the reciprocating arm 161 to apply sufficient force to adhesively affix the label 10 to the surface 31 of the container 30. Once the label 10 has been affixed to the surface 31 of the container 30, the vacuum source may be deactivated to permit withdrawal of the transfer plate 162 from the label 10 without tearing the label 10 from the surface 1 of the container 30. The reciprocating arm 161 moves the transfer plate 162 back to the retracted position to receive another label 10. Although the apparatus 100 has been described with reference to a vacuum-sourced reciprocating transfer affixing 160, those of ordinary skill in the art will understand that any conventional means of receiving the folded-over label 10 from the transfer grid 120 and affixing the label 10 to the container 30 may be substituted in place thereof without departing from either the spirit or the scope of the present invention. Moreover, the orientation of the label 10 as it is affixed to the container 30 may take many forms. For example, the label 10 may be affixed to a vertical sidewall 31 of the container 30, as described in the preferred embodiment hereof. Alternatively, however, the label 10 may be affixed to any other surface of the container 30, such as the underside surface thereof. For example, the so-called "tamp pad" described as a preferred affixing station 160 may be replaced with a device which rolls the label 10 onto the surface 31 of the container 30. Alternatively still, the affixing station 160 may include a device which uses one or more blasts of pressurized air to affix the label 10 to the container 30.

Figure 12:
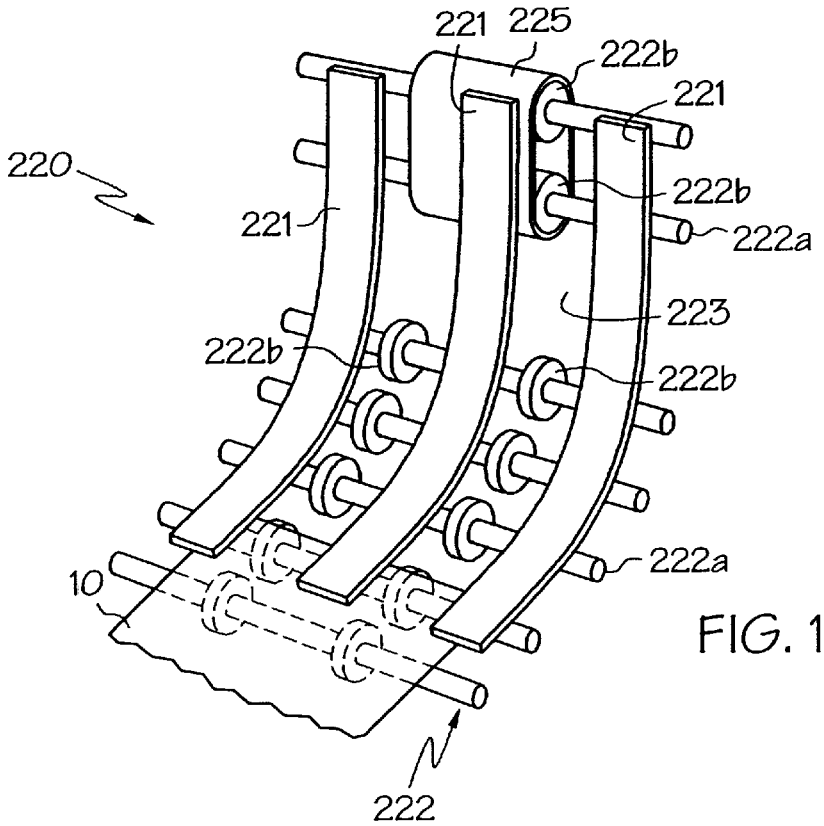
FIG. 12 is a diagrammatic perspective view of a transfer grid section of an apparatus according to an alternative embodiment of the present invention.

With reference to FIG. 12, a transfer grid 220 according to another embodiment of the present invention includes one or more curved guide plates 221 and a row 222 of rollers 222*a* spaced from the guide plates 221 to convey the label 10 therebetween as described above with respect to the preferred embodiment hereof. The guide plates 221 of the present embodiment replace the inner row 121 of rollers 121*a* (FIG. 7) of the preferred embodiment described above. The row 222 of rollers 222*a* of the present embodiment may be identical to the row 122 of rollers 122*a* (FIG. 7), or may include one or more wheels 222*b* spaced between guide plates 221 for contacting the label 10 and for conveying the label 10 through the transfer grid 220 as described with reference to the preferred embodiment hereof. The transfer grid 220 includes an opening 223 defined between two rollers 222*a* of row 222 which permits the label 10 to project from the grid 220 towards the folding station 140 (FIG. 7) as described with reference to the preferred embodiment hereof. Guide plates 221 may also be one continuous guide (not shown) spanning the width of the transfer grid 220. Two or more rollers 222*a* or wheels 222*b* may also be connected to one another in positive drive relationship by a belt 225.

Figure 13:
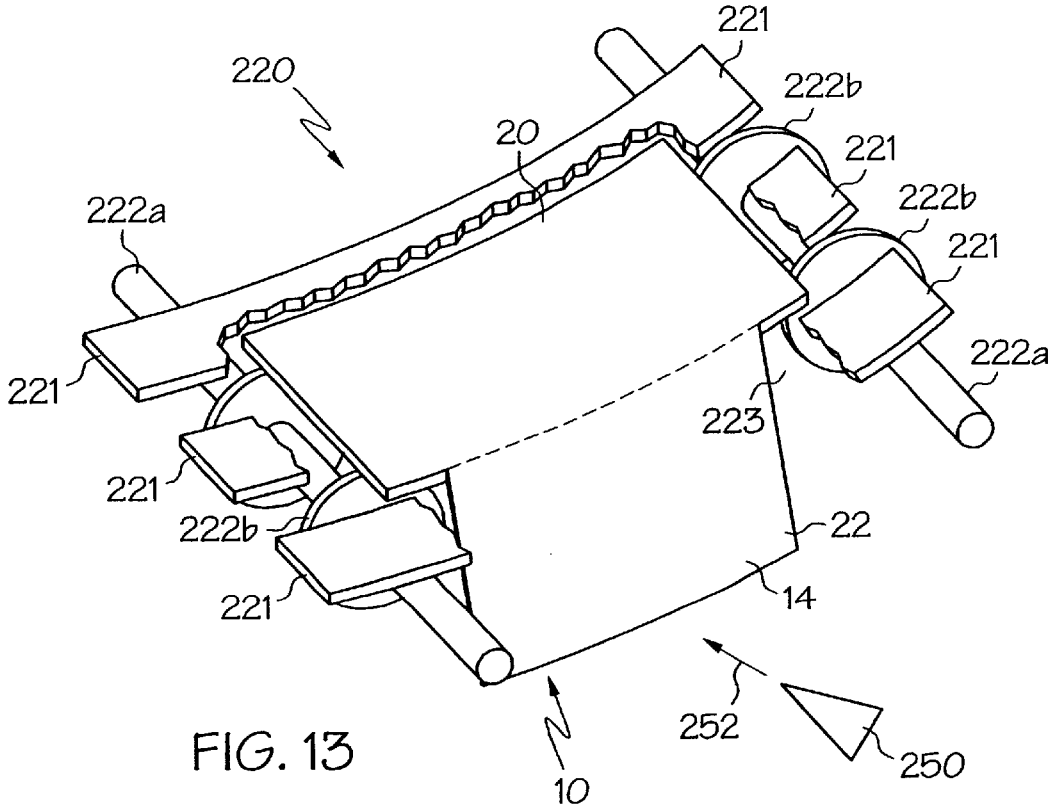
FIG. 13 is a diagrammatic cut-away perspective view of one portion of the apparatus of FIG. 12, further showing an alternative means for sideways folding a label thereby.

With additional reference to FIG. 13, label 10 may alternatively be conveyed through the transfer grid 220 is a sideways orientation, whereby foldable portion 22 projects from cover portion 20 in a direction substantially perpendicular to the forward direction of the label 10 as it is conveyed through the transfer grid 220. Opening 223, then, is sufficiently wide to permit the foldable portion 22 to fall thereinto as the label 10 is conveyed thereby. An air blast nozzle 250 may be positioned to emit a stream of air, generally indicated in the Figures by reference numeral 252, in the direction of the label 10 to urge the foldable portion 22 thereof into a substantially folded-over orientation.

Figure 1:
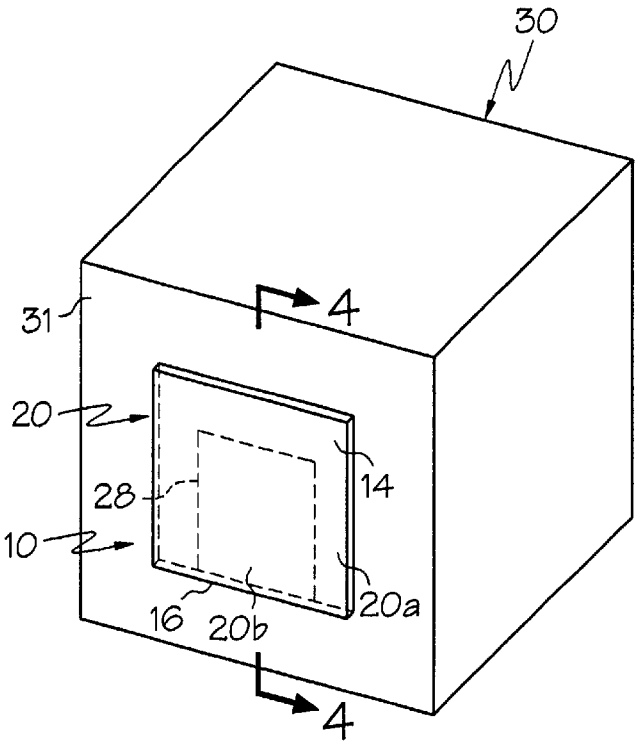
FIG. 1 is an oblique perspective view of a tuck label shown affixed to a container by an apparatus and method according to a preferred embodiment of the present invention.
Figure 3:
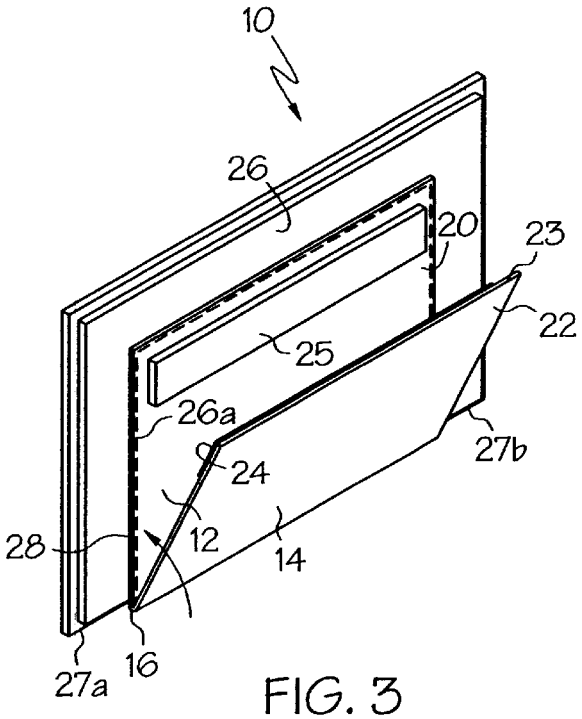
FIG. 3 is the tuck label of FIG. 1, shown in a partially-folded orientation.
Figure 4:
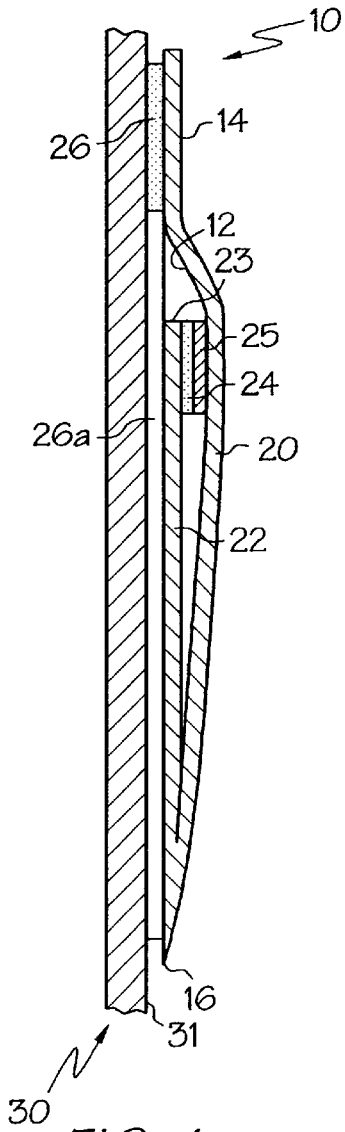
FIG. 4 is a side section view of the tuck label and container of FIG. 1, shown along section line 4—4 of FIG. 1.
Figure 5:
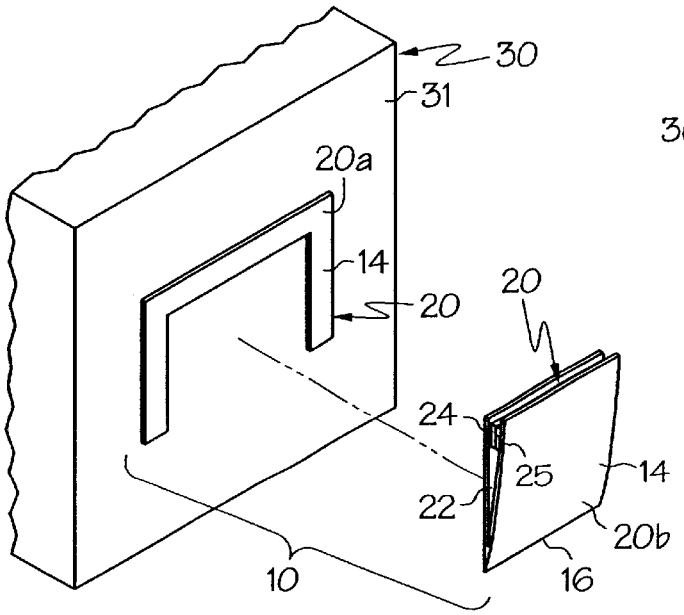
FIG. 5 is an oblique perspective view of the tuck label of FIG. 1, shown with a removable portion having been detached therefrom.
Figure 14:
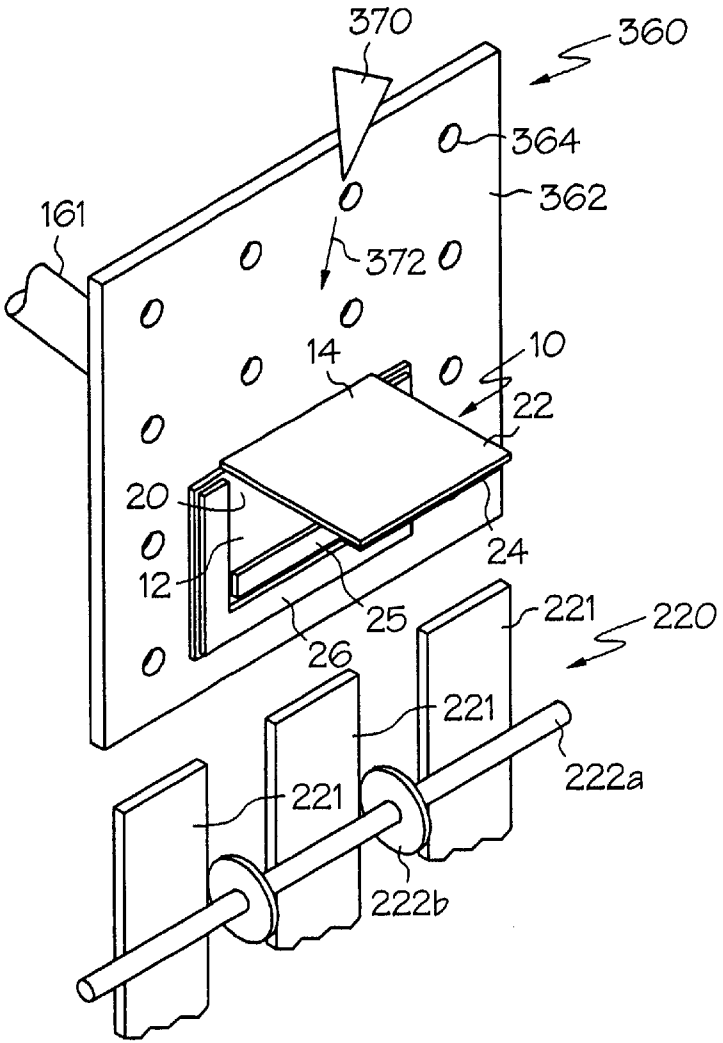
FIG. 14 is a diagrammatic perspective view of a section of an affixing station of an apparatus according to another alternative embodiment of the present invention; and, FIG. 15 is a diagrammatic perspective view of a section of an affixing station of an apparatus according to another alternative embodiment of the present invention.

With reference to FIG. 14, an affixing station 360 according to another alternative embodiment of the present invention includes an air blast nozzle 370 which is adapted to emit a controlled, temporary blast of air, shown generally in the Figures by reference numeral 372, to urge the foldable portion 22 of the label 10 in the substantially folded-over orientation (FIG. 1). In the present embodiment, however, transfer grid 220 is not provided with an opening 223 (FIG. 12), or if it is, transfer grid 220 is provided with means (not shown) for bypassing the opening 223 (FIG. 12), such that label 10 is deposited onto the transfer plate 362 of the affixing station 360 in a substantially unfolded orientation. One or more vacuum nozzles 364 are provided to hold the label 10 thereagainst as it is deposited thereonto as it exits the transfer grid 220. However, prior to affixing the label 10 to the container 30 (FIG. 1), air blast 372 forces the foldable portion 22 of the label 10 away from the transfer plate 362 and urges it over the cover portion 20 of the label 10 such that adhesive strip 245 is affixed to silicone strip 25. Arm 161 then extends to affix the folded-over label 10 to the container 30. Air blast nozzle 370 may also be replaced with an arm or some other reciprocating mechanical device to force the label 10 into the folded-over orientation.

Transfer plate 362 may also be stationary, that is, arm 161 may be a fixed arm which does not reciprocate as described above, but rather, supports transfer plate 362 is in a fixed position above the second end of the transfer grid 220. Container 30 (FIG. 1), then, is conveyed by conveying means (not shown), for example, a conveyor known to one of ordinary skill in the art, alongside fixed transfer plate 362 and is spaced therefrom by a nominal distance, for example, about 1 inch. Vacuum source (not shown) connected to vacuum nozzles 364, then, is adapted to switch between negative (i.e., vacuum) pressure and positive (i.e., blowing) pressure to permit the transfer plate 362 to hold the label 10 thereagainst until the container 30 is adjacent thereto, at which time, the negative pressure supplied to the vacuum nozzles 364 is switched to positive pressure, thereby blowing the label 10 onto the container 30 and adhesively affixing the label 10 thereto.

Figure 15:
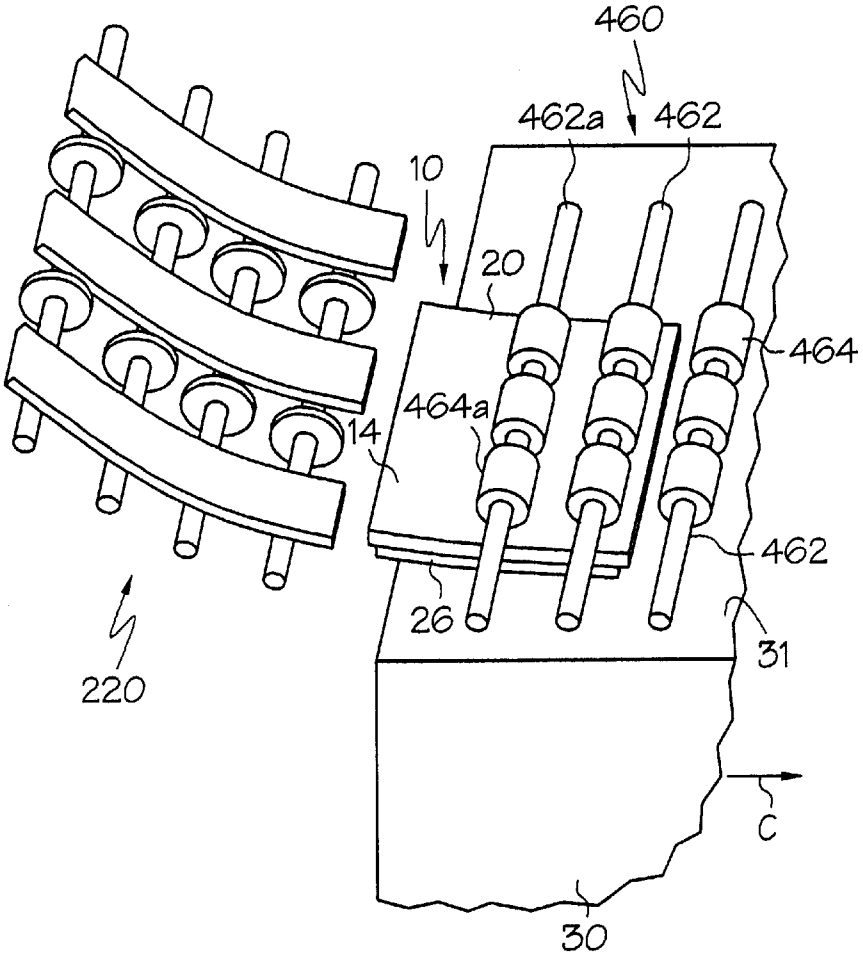

With reference to FIG. 15, an affixing station 460 according to another alternative embodiment of the present invention includes one or more affixing rollers 462, each affixing roller 462 having one or more wheels 464 spaced therealong. Affixing rollers 462 may be driven, for example, by a belt (not shown) connected to positive drive means, such as, a motor (not shown). Affixing rollers 462 and wheels 464 are positioned such that wheels 464 contact the surface 31 of the container 30 as the container 30 is being conveyed alongside the rollers 462 in the direction shown generally as reference letter "C". As such, affixing rollers 462 may be biased, for example, by springs (not shown), against the container 30 to apply nominal pressure thereto. Label 10, exiting the transfer grid 220, is directed between a first row 462*a* of wheels 464*a* and the container 30, such that the label 10 is adhesively affixed thereto, such as, by adhesive border 26.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the above description, the attached drawings and the appended claims. Accordingly, modifications are contemplated which can be made without departing from either the spirit or the scope of the present invention.

We claim:

1. A method of in-line folding and affixing a label to a shipping container, said label having a fold line thereacross, said fold line defining a foldable portion of said label and a cover portion of said label, said method comprising the steps of:

providing a transfer grid for conveying said label from a first end of said transfer grid to a second end of said transfer grid, said transfer grid having an opening intermediate said first and second ends;

providing a folding station adjacent said opening;

providing an affixing station adjacent said second end of said transfer grid;

inserting said label into said first end of said transfer grid;

conveying said foldable portion of said label in a substantially unfolded orientation from said first end of said transfer grid to said opening of said transfer grid such that said foldable portion of said label projects through said opening, while said cover portion of said label is adapted to travel from said first end to said second end without passing through said opening;

folding said foldable portion of said label over said cover portion of said label to define a substantially folded-over orientation of said label;

conveying said label in said substantially folded-over orientation from said opening to said second end of said transfer grid;

receiving said label in said substantially folded-over orientation from said second end of said transfer grid; and affixing said label to said shipping container.

2. The method of claim 1, further comprising the step of urging said foldable portion of said label out of said transfer grid through said opening.

3. The method of claim 2, in which said step of urging said foldable portion of said label out of said transfer grid through said opening includes the step of providing a first air blast nozzle, said first air blast nozzle emitting a stream of pressurized air towards said foldable portion when a portion of said foldable portion is over said opening.

4. The method of claim 1, further comprising the step of urging said foldable portion into said transfer grid through said opening after said foldable portion has been folded over said cover portion.

5. The method of claim 4, in which said step of urging said foldable portion into said transfer grid through said opening after said foldable portion has been folded over said cover portion includes the step of providing a second air blast nozzle, said second air blast nozzle emitting a stream of pressurized air towards said foldable portion when a substantial portion of said foldable portion projects through said opening.

6. The method of claim 1, further comprising the step of urging said label in said substantially folded-over orientation onto said affixing station.

7. The method of claim 6, in which said step of urging said label in said substantially folded-over orientation onto said affixing station includes the step of providing a third air blast nozzle, said third air blast nozzle emitting a stream of pressurized air towards said affixing station when said label being in said substantially folded-over orientation exits said transfer grid through said second end of said transfer grid.

8. The method of claim 1, in which said step of affixing said label to said shipping container includes the step of rolling said label onto said shipping container.

9. The method of claim 1, in which said step of affixing said label to said shipping container includes the step of tamping said label onto said shipping container.

10. The method of claim 1, in which said step of affixing said label to said shipping container includes the step of blowing said label onto said shipping container.

11. A method of in-line folding and affixing a label to a shipping container, said label having a fold line thereacross, said fold line defining a foldable portion of said label and a cover portion of said label, said method comprising the steps of:

providing a transfer grid for conveying said label from a first end of said transfer grid to a second end of said transfer grid, said transfer grid having an opening intermediate said first and second ends;

providing an affixing station adjacent said second end of said transfer grid to receive said label from said transfer grid;

providing means for urging said foldable portion of said label over said cover portion of said label;

inserting said label into said first end of said transfer grid in a substantially unfolded orientation;

conveying said foldable portion of said label through said opening without having said cover portion of said label passing through said opening;

urging said foldable portion of said label over said cover portion of said label to define a substantially folded-over orientation of said label;

conveying said label in said substantially folded-over orientation from said opening to said second end of said transfer grid;

receiving said label at said affixing station in said substantially folded-over orientation from said second end of said transfer grid; and affixing said label at said affixing station in said substantially folded-over orientation to said shipping container.

12. A method of in-line folding and affixing a label to a shipping container, said label having a fold line thereacross, said fold line defining a foldable portion of said label and a cover portion of said label, said method comprising the steps of:

providing a transfer grid for conveying said label, said transfer grid comprising:

a first end configured to receive said label in a substantially unfolded orientation;

a second end configured to dispense said label in a substantially folded-over orientation; and a plurality of rollers configured to convey said label from said first end to said second end, said plurality of rollers defining an opening intermediate said first end and said second end such that said foldable portion of said label is adapted to pass through said opening on the way from said first end to said second end, while said cover portion of said label is adapted to travel from said first end to said second end without passing through said opening;

providing a folding station disposed between said first end and said second end of said transfer grid, said folding station configured to urge a portion of said foldable portion of said label projecting through said opening over said cover portion to define a substantially folded-over orientation of said label;

providing an affixing station adjacent said second end of said transfer grid, said affixing station configured to receive said label from said transfer grid in said substantially folded-over orientation, said affixing station also configured to affix said label to said shipping container;

inserting said label into said first end of said transfer grid;

conveying said foldable portion of said label through said opening without having said cover portion of said label passing through said opening;

folding said foldable portion of said label over said cover portion of said label to define a substantially folded-over orientation of said label;

conveying said label in said substantially folded-over orientation from said opening to said second end of said transfer grid;

receiving said label from said second end of said transfer grid; and affixing said label to said shipping container.

13. The method of claim 12, comprising the additional step of configuring said affixing station to further include a vacuum to temporarily hold said label.

14. The method of claim 12, comprising the additional step of configuring said transfer grid such that a majority thereof is curvilinear.

15. The method of claim 14, comprising the additional step of configuring said plurality of rollers to include an inner row of rollers and an outer row of rollers such that said label is adapted to contact said rollers exclusively.

16. The method of claim 12, comprising the additional step of configuring said folding station to impart no more than one fold in said label.

* * * * *

UNITED STATES PATENT AND TRADEMARK OFFICE

CERTIFICATE OF CORRECTION

PATENT NO. : 6,511,569 B1
DATED : December 20, 2001
INVENTOR(S) : Nixon et al.

It is certified that error appears in the above-identified patent and that said Letters Patent is hereby corrected as shown below:

Column 7,
Line 22, reads as "includes a first end 126A," should read
-- includes a first end 120A, --.

Signed and Sealed this

Twenty-seventh Day of May, 2003

JAMES E. ROGAN
*Director of the United States Patent and Trademark Office*